United States Patent [19]

Creedon

[11] Patent Number: 4,624,173

[45] Date of Patent: Nov. 25, 1986

[54] RAIL GUN BARREL ASSEMBLY

[75] Inventor: Richard L. Creedon, San Diego, Calif.

[73] Assignee: GA Technologies Inc., San Diego, Calif.

[21] Appl. No.: 506,430

[22] Filed: Jun. 21, 1983

[51] Int. Cl.[4] ..... F41F 1/02; F41F 17/08

[52] U.S. Cl. ..... 89/8; 89/16; 124/3; 310/12

[58] Field of Search ..... 89/8, 14.1, 16, 12, 89/1.816; 124/3; 310/10–14; 376/100; 42/76 R, 76 A; 403/362, 366

[56] References Cited

U.S. PATENT DOCUMENTS

| | | | |
|---|---|---|---|
| 502,185 | 7/1893 | Gatling | 89/12 |
| 1,370,200 | 3/1921 | Fauchon-Villeplee | 89/8 |
| 1,421,435 | 7/1922 | Fauchon-Villeplee | 89/8 |
| 1,422,427 | 7/1922 | Fauchon-Villeplee | 89/8 |
| 1,985,254 | 12/1934 | Huse | 89/8 X |
| 2,870,675 | 1/1959 | Salisbury | 89/8 X |
| 2,894,347 | 7/1959 | Woodcock | 42/75 |
| 3,126,789 | 3/1964 | Meyer | 89/8 |
| 3,571,962 | 3/1971 | Eig | 42/76 |
| 3,626,506 | 12/1971 | Spieth | 403/366 X |
| 3,727,513 | 4/1973 | Wicks | 89/14.1 |
| 3,777,385 | 12/1973 | Hagan | 89/16 X |
| 4,296,669 | 10/1981 | Debona et al. | 89/1.816 |
| 4,319,168 | 3/1982 | Kemeny | 124/3 X |
| 4,343,223 | 8/1982 | Hawke et al. | 89/8 |
| 4,347,463 | 8/1982 | Kemeny et al. | 310/13 |
| 4,424,734 | 1/1984 | Janssen et al. | 89/16 |
| 4,433,608 | 2/1984 | Deis et al. | 89/8 |
| 4,458,577 | 7/1984 | Fisher et al. | 89/8 |

OTHER PUBLICATIONS

DTIC Technical Report AFATL-TR-81-99, pp. 95–102, Coauthored by I. R. McNab and D. W. Deis, published Nov. 1981.

*Primary Examiner*—David H. Brown
*Assistant Examiner*—John E. Griffiths
*Attorney, Agent, or Firm*—Fitch, Even, Tabin & Flannery

[57] ABSTRACT

A rail gun barrel assembly includes barrel components which are radially constrained by a pressure medium contained within a lightweight outer shell.

1 Claim, 4 Drawing Figures

FIG. 1
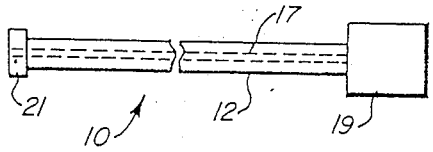
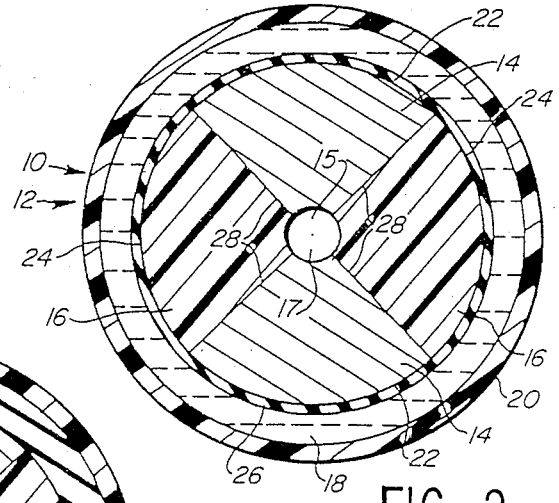
FIG. 2
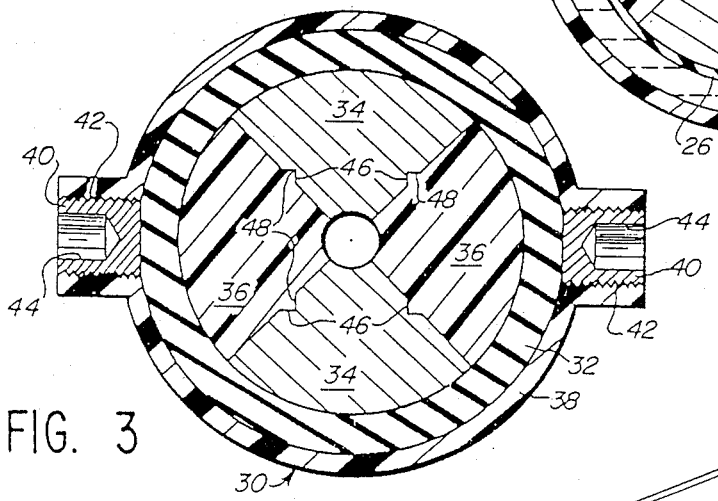
FIG. 3
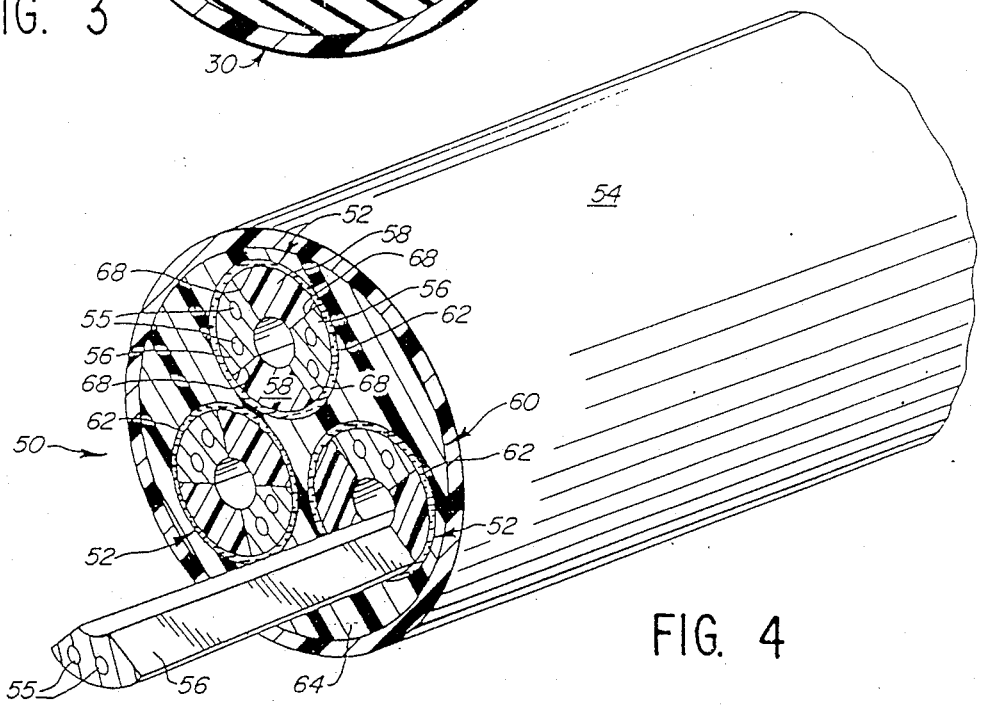
FIG. 4

RAIL GUN BARREL ASSEMBLY

BACKGROUND OF THE INVENTION

The present invention relates to a barrel assembly for an electromagnetic rail guns.

Various types of rail guns have been proposed for using electromagnetic forces to accelerate projectiles to high velocities and direct them toward targets. See, for example, U.S. Pat. No. 1,985,254.

A typical rail gun includes an elongated barrel which has a pair of longitudinally extending parallel conductors or rails disposed symmetrically about its axis. The rails are connected at their rearward, or breech ends to opposite terminals of a source of direct current. A circuit through the rails may be completed either by a conductor disposed between the rails or by a plasma arc between the rails. This results in the flow of current which generates magnetic flux between the rails. The flux cooperates with the current in the conductor or the plasma to accelerate the conductor or plasma forward between the rails. The projectile may include the conductor or may be positioned forward of the conductor or plasma arc and driven forward thereby.

In addition to accelerating the projectile forward, electromagnetic forces generated during firing of the rail gun include bursting forces which tend to push the rails outward. Additional bursting forces may result from gas pressure generated by the plasma arc within the barrel. When the rail gun is fired, the rails conduct very high electrical current and are thus heated to high temperatures while being subjected to these bursting forces. The rails may be damaged during operation of the gun, and it therefore may be desirable that the rails be removable for maintenance.

The bursting forces are comparable in magnitude to those experienced in barrels of conventional chemical explosive guns. However, the tubular containment used in such guns does not solve the problems presented by rail guns.

In the rail gun, it is desirable that the two removable rails and the adjacent insulating members fit together with very close tolerances and be tightly constrained against displacement radially outward. It is also desirable that the barrel be relatively light so that it may be moved rapidly for aiming. A typical known rail gun barrel assembly employs a large number of bolts to clamp stiff structural members about the barrel components to react bursting forces. This type of arrangement is unsatisfactory for several reasons. The weight of the clamping members and bolts is relatively high, since they are generally made of steel or the like and must be fairly heavy in order to apply the required forces to the barrel component. The structural members and bolts are also relatively expensive. In addition, adjustment of the bolts is time consuming due to their number and due to the fact that fairly precise adjustments of the bolts are necessary in order to apply the desired pressure to the barrel components.

SUMMARY OF THE INVENTION

In accordance with the present invention, a rail gun barrel assembly is provided wherein the various barrel components are compressively stressed by a surrounding pressure medium. Any one of several suitable materials may be used as a pressure medium.

In accordance with one embodiment, a thermosetting resin is used. The resin may be cured after it is pressurized to maintain a desired pressure on the barrel components.

In accordance with a second embodiment, an elastomeric material is used as a pressure medium. The pressure on the barrel components may be controlled by screw pistons adjustable from the exterior of the shell.

In accordance with a third embodiment, a fluid such as oil or water may be used as a pressure medium. Use of such a fluid has an advantage in that it enables the rails to be removed for maintenance simply by reducing the pressure in the medium and sliding the rails out. Installation of rails may be accomplished simply by positioning the rails within the sleeve and subsequently pressurizing the pressure medium.

The barrel assembly may include a single barrel positioned substantially coaxially within an outer shell which contains the pressure medium, or may include a plurality of barrels disposed within a single outer shell. In either case, the pressure medium applies relatively uniform radial forces to the rails and insulating members while transmitting relatively evenly distributed stresses to the outer shell.

Accordingly, it is a general object of the present invention to provide a rail gun barrel assembly wherein a pressure medium is employed to constrain barrel components against bursting pressures.

Further objects of the present invention will become apparent from the following detailed description taken in conjunction with the accompanying drawings.

BRIEF DESCRIPTION OF DRAWINGS

FIG. 1 is a diagrammatic side elevational view of a rail gun barrel assembly in accordance with the present invention.

FIG. 2 is an enlarged transverse sectional view of a rail gun barrel assembly in accordance with one embodiment of the present invention.

FIG. 3 is an enlarged transverse sectional view of a rail gun barrel assembly in accordance with a second embodiment of the present inventon.

FIG. 4 is an enlarged isometric drawing, partially in section and with portions broken away for clarity, of a rail gun barrel assembly in accordance with a third embodiment of the invention.

DESCRIPTION OF THE PREFERRED EMBODIMENTS

The present invention is embodied in a rail gun barrel assembly defining one or more elongated bores for passage of a projectile. Referring to FIGS. 1 and 2, there is shown a rail gun barrel assembly 10 comprising a single barrel 12 which includes a pair of elongated, generally parallel conductive rails 14 and a pair of elongated, generally parallel insulating members 16 disposed circumferentially between the rails 14.

The rails 14 are disposed symmetrically about the longitudinal axis of the barrel, as are the insulating members 16. The rails 14 may be made of a copper alloy or other conducting material and are electrically connected at their respective rearward or breech ends to opposite terminals of a source of direct current (not shown). Means 19 for loading projectiles into the barrel are provided at the breech end. The rails may have longitudinal passages (not shown) formed in them for coolant flow.

The rails 14 and insulating members 16 herein define a generally cylindrical bore 17 through which the projectile (not shown) travels. The bore 17 may be of circular cross section as shown, or may alternatively be of rectangular or other suitable cross section.

A circuit through the rails may be completed either by a conductor or a plasma arc disposed between the rails. Where a plasma arc is used, high fluid pressures are generated within the barrel by vaporization of a strip metal. As current flows through the circuit, magnetic flux is generated between the rails. The magnetic flux cooperates with the current in the conductor or plasma arc to accelerate the conductor or plasma forward between the rails. The projectile may include the conductor or may be positioned forward of the conductor or plasma arc and driven forward thereby. It is desirable that the rails 14 and insulating member 16 be constrained against radial movement. When the rail gun is fired, bursting forces resulting from the interaction of the current with the flux tend to push the rails 14 apart. In addition, where a plasma arc is present within the bore 17, high fluid pressures create bursting forces which tend to force both the rails 14 and insulating members 16 radially outward. In the past, it has been recognized that loading the rails 14 and insulating members 16 prior to firing with forces directed radially inward—i.e., preloading the rails—may constrain them as desired. Past attempts to preload the rails have involved mechanical systems that have been relatively heavy, complex, and difficult to adjust.

In accordance with the present invention, a barrel assembly is provided which is relatively lightweight and which enables a desired level of preload pressure to be applied to the rails and insulating members relatively simply. The rails 14 and insulating members 16 are constrained against displacement radially outward and preloaded by a pressure medium 18 which surrounds them peripherally. A lightweight, relatively rigid outer shell 20 having sealing means 21 at its ends contains the pressure medium. The pressure medium 18 applies approximately uniform radial compression forces to the peripheral surfaces 22, 24 of the rails 14 and insulating members 16 respectively, and applies relatively evenly distributed radial stresses to the outer shell 20. The pressure medium is pressurized prior to firing of the gun. To this end, it may be a material having relatively low shear strength such as fluid or a suitable elastomer. In the alternative, it may be a resin which can be pressurized and subsequently cured prior to firing the gun.

As stated above, high fluid pressure or gas pressure may be generated within the bore during firing due to the plasma arc. This pressure, in combination with the electromagnetic forces generated on the rails during firing, tends to push the rails 14 and insulating members 16 apart. If the rails and insulating members are constrained adequately, the stresses experienced by the inner portions of the rails 14 and insulating members 16 adjacent the bore are distributed over relatively large peripheral surfaces 22, 24 and transmitted to the outer shell 20. If the rails and insulating members move outward during firing, high pressure gases within the bore may leak through the interfaces 28 between the rails 14 and insulating members 16, and cause the shell 20 to burst. In accordance with the present invention, the pressure medium 18 supplies preload to the rails and insulating members sufficient to effectively seal the interfaces 28 from high pressure gas.

In the embodiment of FIG. 2, the pressure medium may be a fluid such as water or oil, or in the alternative may be a resin which is pressurized as a liquid and subsequently cured. In this embodiment, a relatively flexible sleeve or membrane 26 fits over the rails 14 and insulating members 16 to prevent the pressure medium 18 from leaking into the interfaces 28 between the rails 14 and insulating members 16. Any suitable external pressurizing means (not shown) may be employed to bring the pressure medium to the desired pressure.

Where the pressure medium 18 is a fluid such as water or oil, it is maintained at the desired pressure during firing of the gun, but may be subsequently permitted to return to a lower pressure. Where the pressure medium is a resin, the resin is cured prior to use of the barrel 12 to set it at a predetermined pressure.

Use of a fluid such as water or oil facilitates removal of the rails 14 for maintenance in that it enables the pressure on the rails to be removed simply by reducing the pressure in the fluid. Use of a resin, on the other hand, provides a different advantage in that once the resin is cured, maintenance of pressure no longer requires maintenance of seals about the pressure medium 18. This may simplify assembly of the barrel and may permit the use of barrel configurations which would not be feasible with a fluid such oil or water.

For purposes of clarity of illustration, the cross-sectional area of the pressure medium 18 is disproportionately illustrated in the drawings. It may actually be a layer having a relative thickness much less than that shown. The thickness of this layer may be, for example, on the order of 0.5 mm.

The outer shell 20 is preferably made of a non-metallic material. For example, it may be composed of woven silicon carbide fibers disposed within a resin, or may be composed of a glass composite material.

Referring to FIG. 3, there is shown a barrel assembly 30 in accordance with a second embodiment of the invention wherein an elastomeric material 32 is used as a pressure medium. The barrel assembly 30 includes rails 34 and insulating members 36 disposed within an outer shell 38 in a configuration generally similar to that described above in connection with the embodiment shown in FIG. 2. Preferably, the elastomer 32 has relatively low shear strength and a relatively high bulk modulus. The elastomer may be compressed by screw pistons 40 which engage internally threaded bores 42 extending outwardly from the shell. The screw pistons 40 herein have outwardly facing sockets 44 to accommodate allen wrenches or the like. Rotation of the screw pistons moves them inward or outward to increase or decrease the pressure on the elastomer 32, which correspondingly increases or decreases the pressure on the rails 34 and insulating members 36. The screw pistons 40 may be arranged in longitudinal rows (not shown) along opposite sides of the barrel assembly 30.

In the embodiment illustrated in FIG. 3, each rail 34 has longitudinal grooves 46 formed in its sides which cooperate with interfitting raised ridges 48 on the adjacent insulating members 36 to maintain the rails 34 and insulating members 36 in predetermined radial position relative to one another.

A limitation on the rate of firing of a rail gun may be the rate at which the barrel is cooled. To enable a rail gun to maintain a faster rate of firing, it may be desirable to provide a plurality of barrels for the gun.

Referring to FIG. 4, there is shown a multiple barrel assembly 50 wherein a plurality of barrels 52 are disposed within a single outer shell 54. Each barrel 52 comprises a pair of rails 56 and a pair of insulating members 58 interfitting as in the barrels described above. Longitudinal cooling passages 55 are shown extending through the rails.

In accordance with the present invention, a pressure medium, indicated generally at 60, is employed to preload the barrels 52 with force directed radially inward about the periphery of each. The preferred pressure medium 60 comprises relatively thin layers 62 of fluid disposed about the barrels and a filler 64 of relatively rigid material surrounding the various fluid layers 62 and barrels 52. The filler 64 may be a plastic structure with longitudinal bores formed through it to accommodate the barrels 52 and fluid layers 62. Sealing sleeves or membranes (not shown) may be disposed about each of the barrels 52 to seal the fluid 62 from the interfaces 68 between the rails and insulating members. Inclusion of a plurality of barrels 52 within a single outer shell 54 provides a multiple barrel assembly 50 which may be lighter than a multiple barrel assembly wherein each barrel 52 has its own shell.

From the foregoing, it will be appreciated that the present invention provides a novel rail gun barrel assembly. While various embodiments of the invention have been shown and described herein, there is no intent to limit the scope of the invention to these or any particular embodiments.

What is claimed is:

1. A rail gun barrel assembly defining an elongated bore, said barrel assembly comprising:

a pair of elongated, generally parallel conductive rails extending along opposite sides of said bore and being symmetrical about a longitudinal axis of said bore;

a pair of elongated insulating members disposed generally coextensively with said rails and circumferentially between them; said insulating members abutting said rails to define interfaces extending outward from said elongated bore;

a pressure medium disposed about said rails and said insulating members; and a relatively stiff outer shell disposed about and containing said pressure medium, said shell being separated from said rails and insulating members by said pressure medium;

said pressure medium being pressurized so as to apply pressure radially inwardly on said rail and insulating members to preload said rails and insulating members, said rails and insulating members being compressively stressed by said pressure medium, said interfaces being thereby sealed against entry of high pressure gas from said bore during firing;

said pressure medium being in solid phase and being a material capable of being cured from liquid to solid phase so that the barrel may be manufactured by injecting the pressure medium as a liquid, pressurizing it, and curing it to solid phase.

* * * * *

UNITED STATES PATENT AND TRADEMARK OFFICE

CERTIFICATE OF CORRECTION

PATENT NO. : 4 624,173

DATED : November 25, 1986

INVENTOR(S) : Richard L. Creedon

It is certified that error appears in the above-identified patent and that said Letters Patent is hereby corrected as shown below:

Column 1, line 6, delete "an".

Column 6, line 19, Claim 1, change "rail" to --rails--.

Signed and Sealed this

Seventh Day of April, 1987

*Attest:*

DONALD J. QUIGG

*Attesting Officer*

*Commissioner of Patents and Trademarks*